US006808476B2

(12) United States Patent
Zagone

(10) Patent No.: US 6,808,476 B2
(45) Date of Patent: Oct. 26, 2004

(54) EXERCISE APPARATUS

(76) Inventor: William Zagone, 2010 SE. 100th Ct., Vancouver, WA (US) 98664

( * ) Notice: Subject to any disclaimer, the term of this patent is extended or adjusted under 35 U.S.C. 154(b) by 198 days.

(21) Appl. No.: 10/159,201

(22) Filed: May 29, 2002

(65) Prior Publication Data

US 2003/0224912 A1 Dec. 4, 2003

(51) Int. Cl.[7] ..... H63B 23/04
(52) U.S. Cl. ..... 482/80; 482/123; 482/129
(58) Field of Search ..... 482/79, 80, 51, 482/52, 53, 112, 113, 904, 907; 601/27, 35, 29, 31–34

(56) References Cited

U.S. PATENT DOCUMENTS

| | | | | |
|---|---|---|---|---|
| 1,587,749 | A | | 6/1926 | Bierly |
| 2,830,816 | A | * | 4/1958 | Uhl |
| 3,020,046 | A | | 2/1962 | Hotas |
| 3,134,591 | A | | 5/1964 | Conn, Jr. et al. |
| 3,297,320 | A | | 1/1967 | Benedetto |
| D208,787 | S | | 10/1967 | Bennstrom-Prescott |
| 3,523,310 | A | * | 8/1970 | Shead |
| 3,582,066 | A | | 6/1971 | Keryluk |
| 3,814,420 | A | | 6/1974 | Encke |
| 4,111,416 | A | | 9/1978 | Jinotti |
| 4,279,415 | A | | 7/1981 | Katz |
| 4,483,533 | A | | 11/1984 | Mangiapane |
| 4,739,986 | A | | 4/1988 | Kucharik et al. |
| 5,069,445 | A | * | 12/1991 | Mai |
| 5,178,596 | A | | 1/1993 | McIntire |
| 5,433,684 | A | * | 7/1995 | Carrillo ..... 482/80 |
| 5,487,711 | A | | 1/1996 | Little |
| 5,499,958 | A | * | 3/1996 | Hess ..... 482/79 |
| 5,669,862 | A | | 9/1997 | Sayman |
| 6,042,523 | A | * | 3/2000 | Graham ..... 482/121 |
| 6,244,992 | B1 | | 6/2001 | James |

* cited by examiner

*Primary Examiner*—Jerome W. Donnelly
(74) *Attorney, Agent, or Firm*—Ipsolon llp

(57) ABSTRACT

An exerciser includes an exercise module defined by hinged first and second plates with a spring therebetween to provide biasing resistance, and a bracket member for attaching the exercise module to a surface such as a bed. The exerciser provides a simple means for exercising, especially for users in a supine position.

20 Claims, 2 Drawing Sheets

EXERCISE APPARATUS

FIELD OF THE INVENTION

This invention relates to exercise equipment, and more particularly to an exercise apparatus designed for use by individuals while in a supine position, such as bed-ridden patients and/or non-ambulatory individuals.

BACKGROUND

The benefits derived from regular and routine physical exercise are well known and documented. So, too, are the adverse effects that may result from a lifestyle that omits regular physical exercise. As a result, regular exercise in some form is encouraged for nearly all individuals, ranging from individuals in perfect health to patients confined to a bed. For healthy, ambulatory individuals, exercise is obviously much easier accomplished compared to people who have some ailment or condition that causes limitation in the manner in which physical activity is carried out. Physical activity is, for the later class of individuals, no less important than it is for healthy people, but it may be more difficult to perform given the physical conditions and limitations that may be present.

While there are innumerable ways of exercising, many of which require no special equipment at all, there also are scores of devices on the market for assisting exercise in order to make it more enjoyable, safe and efficient. Indeed, there are seemingly as many different exercise devices as there are types of exercise. But when it comes to individuals who are confined to a bed or wheelchair or the like, or have difficulty moving around, the available options in exercise equipment are more limited. Although there are numerous different exercise devices designed for use by bed-ridden and non-ambulatory patients, many such devices tend to be expensive, complicated and unwieldy. Moreover, for patients confined to a bed it may be difficult to provide a device designed to provide leg exercises since there may be few options for attaching the device to the bed.

There is a continuing need for exercise equipment useful to individuals who need to exercise while lying in a supine position.

SUMMARY

An exercise apparatus includes hinged plates with a spring therebetween and a bracket for mounting the plates to a surface such as a bed. The user pushes a first plate toward a second plate against the biasing force provided by the spring to exercise.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

The illustrated exercise apparatus is designed to be used primarily, although not exclusively, by individuals while in a supine or inclined position. For example, patients confined to a bed or the like may use apparatus 10 as part of a physical therapy program to assist in recovery from surgery. There are numerous other instances in which apparatus 10 may be used. For example, the apparatus and mounting bracket may be adapted for use by people in wheelchairs. Moreover, fully ambulatory, healthy individuals who want to exercise while reclining or lying down may well use it the invention. Accordingly, while the invention is described in respect of the illustrated embodiment and with respect to its manner of use in various ways and by various individuals, it will be appreciated that the invention is not limited to use by any specific type of individual or in any particular setting or position. Instead, the invention is to be limited in scope only by the claims appended hereto.

Figure 1:
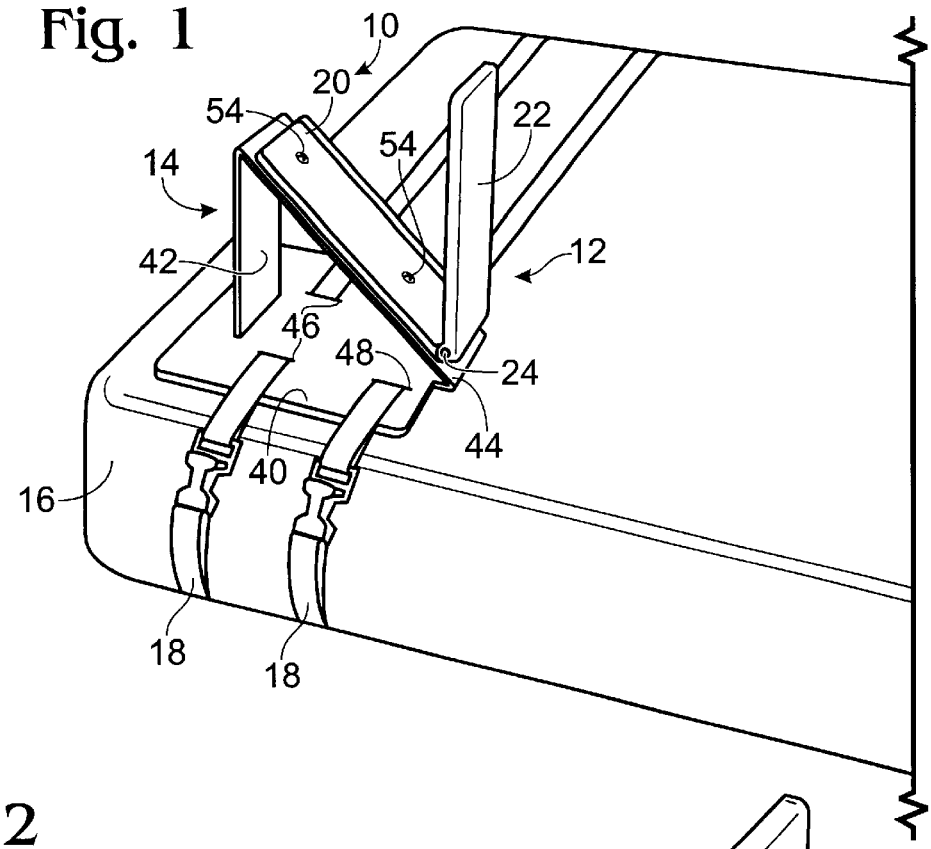
FIG. 1 is a perspective view of an exercise apparatus according to the present invention mounted on a bed mattress.

With reference now to FIG. 1, the illustrated embodiment of an exercise apparatus 10 according to the present invention includes an exercise module 12 that is removably mounted to a mounting bracket 14, which in turn is, in the illustration of FIG. 1, mounted onto a mattress 16 with adjustable straps 18 that encircle the mattress.

Figure 2:
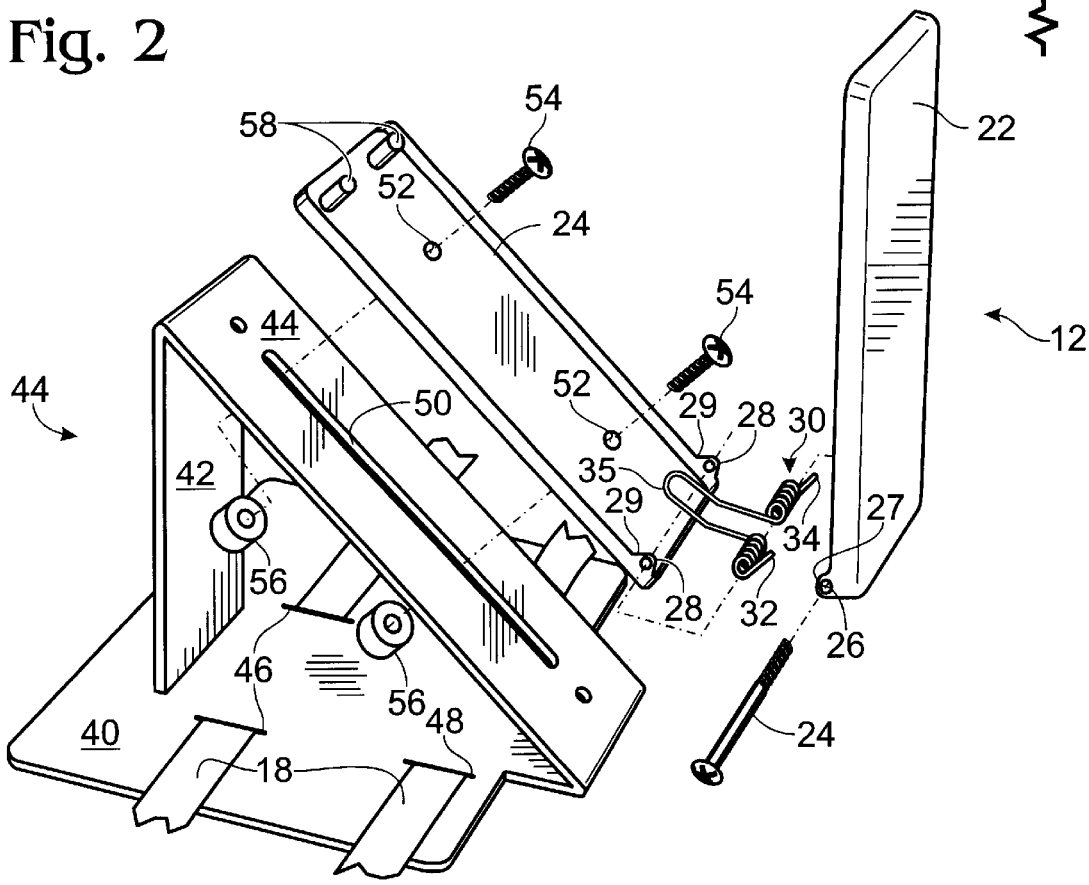
FIG. 2 is a partially exploded perspective view of the exercise apparatus shown in FIG. 1, illustrating the exercise module and the mounting bracket.

As illustrated in FIGS. 1 and 2, exercise module 12 comprises a base plate member 20 and an upper plate member 22. Plate members 20 and 22 are pivotally coupled together at respective ends thereof with a pin 24 that extends through openings 26 in tabs 27 formed in upper plate member 22, and through openings 28 in tabs 29 in base plate member 20.

Figure 4:
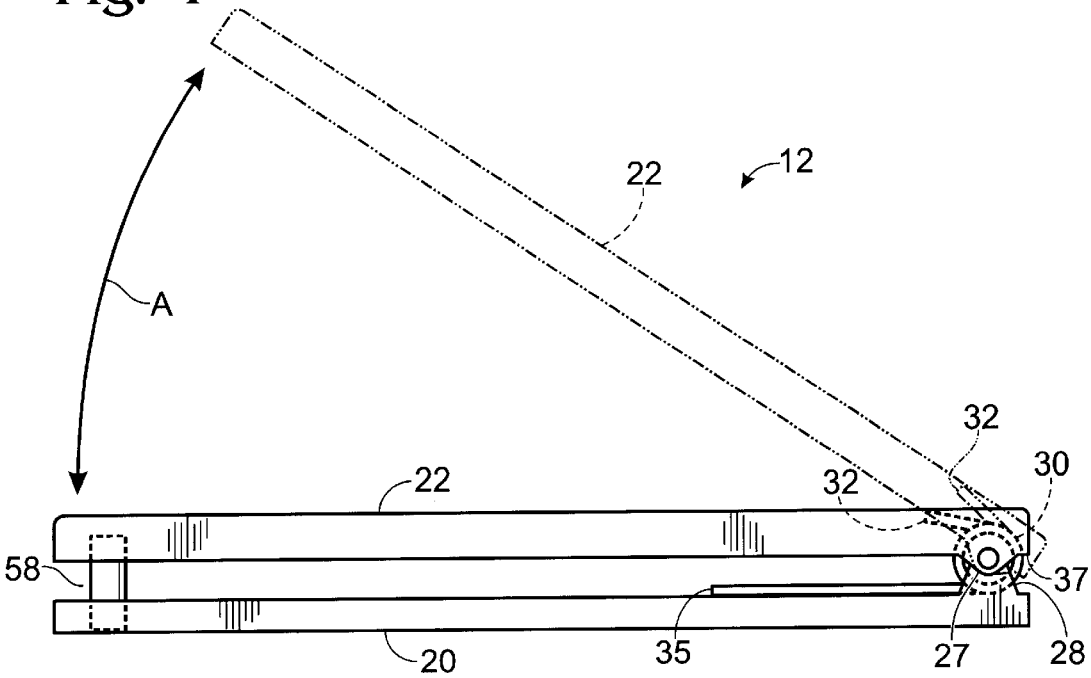
FIG. 4 is a side elevation view illustrating the exercise module and its range of motion between a first and second position, illustrated in phantom lines.

As shown in FIGS. 1 and 2, when plates 20 and 22 are assembled, openings 26 align with openings 28 to allow for pin 24 to define a hinged, pivotal connection between the plates. A spring member such as a torsion spring 30 provides a biasing resistance between plate members 20 and 22. Specifically, torsion spring 30 has a first end 32 and an opposite end 34 that contact and bear against upper plate 22. A central extended portion 35 of spring 30 is configured to contact and bear against plate member 20 as shown in FIG. 2, with the result being that upper plate 22 is normally biased away from the base plate about pin 24 and into the position shown in FIG. 1. With reference now to FIG. 4, it may be seen that a shoulder 37 formed on upper plate member 22 extends beyond tab 27 (only one shoulder 37 is shown in FIG. 4, although there is a shoulder 37 on each side of the upper plate member). When upper plate 22 is in the normally open position shown in FIG. 1, shoulders 37 abut tabs 28 of base plate 20 and function as a keeper that limits the movement of upper plate 22 away from base plate 20 beyond a desired position such as that shown in FIG. 1.

Torsion spring 32 defines a biasing force between upper plate 22 and base plate 20 so that the two plates are normally biased apart from one another into a first, open position. Thus, spring 32 normally biases upper plate 22 about the hinge defined by pin 24 and away from base plate 20 into the first position shown in FIG. 1. It will be appreciated that there are numerous equivalent structures that may be used to both pivotally interconnect base plate 20 with upper plate 22, and also to provide the biasing force between the two plates. As just one example, a cylindrical spring may be interposed between the two plate members. It will further be appreciated that the biasing force required to move upper plate 22 toward base plate 20 may be altered by altering the strength of the spring or other biasing means used. Stated otherwise, the force required to move upper plate 22 toward base plate 20 may be altered by varying the spring force applied between the two plates.

Figure 3:
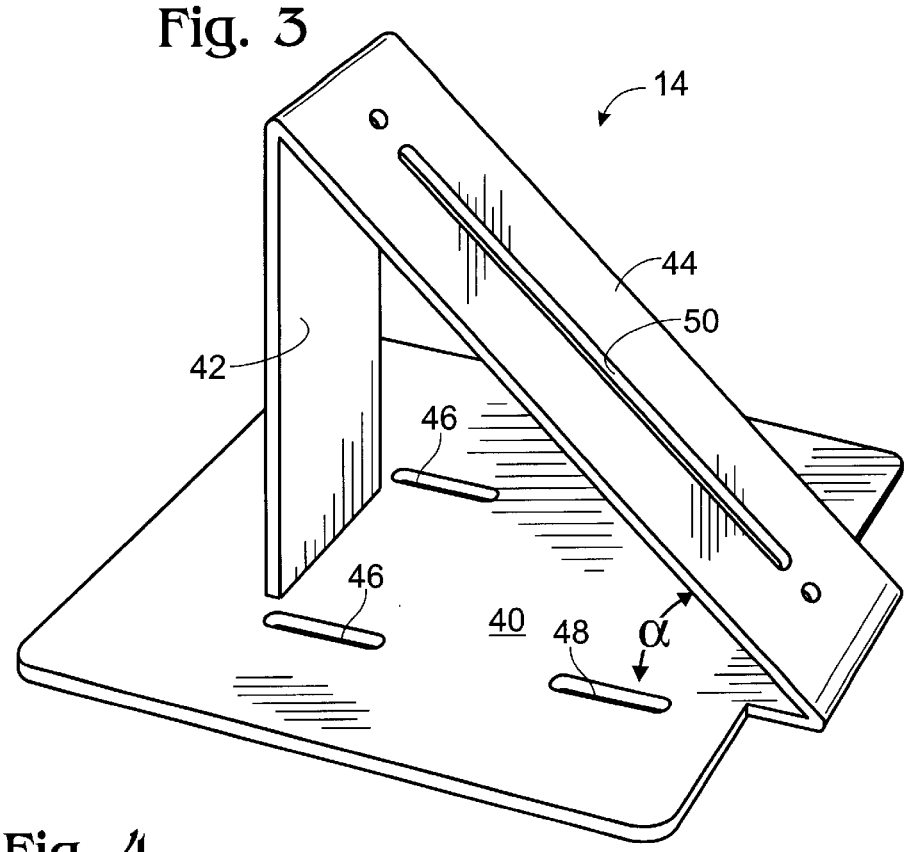
FIG. 3 is a perspective view of the mounting bracket.

Mounting bracket 14 defines means by which exercise module 12 may be mounted on a surface such as mattress 16, and comprises a generally triangular bracket having a base 40, an upright arm 42 and an angular arm 44 that interconnects the base and the upright arm to define a triangle, as best shown in FIG. 3. A first pair of slots 46 and a second pair of slots 48 (only one of which is shown in FIG. 3) is cut through base 40. Straps 18 are threaded through slots 48 and 48 as shown in FIGS. 1 and 2 and the straps extend around mattress 16 to secure the mounting bracket to the mattress. Base 40 is relatively wider than upright arm 40 and angular arm 42 to provide stability when the base is mounted to a surface. The mounting bracket 14 shown in the figures has a fixed angle of inclination (shown as angle $\alpha$ in FIG. 3) between angular arm 44 and base 40. It will be appreciated that the bracket may be fabricated with any angle between the arm and the base, or may be made so that the angle $\alpha$ between angular arm 44 and base 40 is adjustable. As one example of the many ways in which the angular arm may be made adjustable, it may be hinged to the base plate at the junction between the two, and at its upper end may include means for variable positioning along the length of the upright arm member, such as stepped supports or ratchets and the like.

Referring now to FIGS. 1, 2 and 3, exercise module 12 is adapted to be removably mounted to angular arm 44 of mounting bracket 14, and preferably so that the position of module 12 along arm 44 is adjustable. In the illustrated embodiment a longitudinal slot 50 is cut through angular arm 44. A pair of openings 52 (FIG. 2) is formed in base plate 20. Openings 52 are spaced apart by a distance that is less than the length of slot 50. Module 12 is attached to bracket 14 by inserting screws 54 through openings 52 in plate 20 and through slot 50 in arm 44. Nuts 56 are then threaded onto screws 54. The position of module 12 relative to arm 44 may be adjusted by loosening nuts 56 and sliding module 12 such that screws 54 move longitudinally in slot 50. When the module is in the desired position the nuts are tightened to thereby fix the position of the module relative to the arm 44. It will be appreciated that there are numerous equivalent manners in which module 12 may be attached to bracket 14 and that the invention is not limited by the particular manner in which these two components are interconnected.

Turning now to FIG. 4 it may be seen that module 12 is movable between a normally opened position, which in FIG. 4 is shown with the upper plate 22 (shown in dashed lines) biased away from base plate 20, and a closed position wherein upper plate 22 is adjacent base plate 20, as shown. The range of motion is illustrated with arrow A.

In use, the exercise module 12 is mounted to bracket 14 in the manner detailed above, and the bracket is mounted in a desired position on mattress 16 with straps 18 encircling the mattress. The straps are tightened to eliminate or minimize relative movement between the apparatus 10 and the mattress during use. A user places his or her foot (or hand) onto upper plate 22 and pushes the upper plate to move it from the open position to the closed position, against the biasing force of spring 30, then releases pressure on the upper plate to allow the upper plate to move to the open position. This motion is repeated to provide exercise, each single opening and closing of the apparatus defining a single repetition. The surface defined by mattress 16 in FIG. 1 is roughly horizontal relative to the ground plane. It is to be appreciated that the exercise apparatus 10 may be adapted to other surfaces as well, including for example beds and the like that are angled relative to the ground plane. In such instances it may be beneficial to alter the angle $\alpha$ defined between base plate 40 and angular arm 44 of bracket 14, as described above. It further will be appreciated that bracket 14 may be mounted to most any surface in addition to a mattress, for example, a wheelchair foot rest.

Various modifications and additions may be added to the components described above. For example, although not shown in the illustrations, a latch may be provided to interconnect upper plate 22 with base plate 20 and hold the plates together in the closed position, for example, during storage. Further, those of ordinary skill in the art will appreciate that a damper may be included between the two plates to minimize any clapping noise caused by repetitive exercise motion. Suitable dampening may be accomplished with one or more rubber members 58 in base plate 20 (FIGS. 2 and 4). Moreover, a counter (mechanically activated or electronic) may be included with a display that indicates to the user how may repetitions the user has completed. If a mechanical counter is used, it may be mounted such that the user may easily see the display, and such that the counter activation switch is tripped with each repetition. An electronic counter can be similarly mounted, but of course would use an electronic switch member such as a micro switch. A timer may also be optionally included, the timer being started when the user begins exercising and optionally including a display to give the user an indication of the duration of the exercise session.

The components of apparatus 10 may be fabricated from any appropriate material, such as metal and/or plastics. Preferably, both exercise module 12 and bracket 14 are fabricated from stainless steel.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. An exercise apparatus, comprising:

first plate having first and second ends;

second plate having first and second ends and pivotally connected to the first plate and respective first ends thereof;

a spring disposed between the first and second plates and biasing the first and second plates into a first position in which the first and second plates are separated from one another;

a bracket defining a generally triangular support having a base member, an upright member and an angular member interconnecting the base member and the upright member, wherein the second plate is removably mounted to the angular member; and a strap capable of mounting bracket to a support surface.

2. The exercise apparatus according to claim 1 wherein the bracket is mounted on a surface.

3. The exercise apparatus according to claim 2 wherein the surface defines a mattress.

4. The exercise apparatus according to claim 3 wherein the base member is mounted to the mattress with at least one strap that encircles the mattress and connects to the base member to minimize relative movement between the mattress and the base member.

5. The exercise apparatus according to claim 4 wherein the at least one strap extends through a pair of slots in the base member.

6. The exercise apparatus according to claim 5 wherein the base member is wider than the upright arm member to define a stable platform for supporting the bracket on the mattress.

7. The exerciser apparatus according to claim 1 wherein the angular member has a longitudinal slot therein and the first plate is mounted to the angular member for adjustable movement along the longitudinal slot.

8. The exercise apparatus according to claim 7 including at least one fastening member extending through the second plate and the longitudinal slot.

9. The exercise apparatus according to claim 1 wherein the first plate is repetitively movable relative to the first plate between the first position and a second position, and wherein each movement of the first plate from the first position to the second position defines a repetition, and further including a counter having a display for providing the user with a visual indication of the number of repetitions.

10. The exercise apparatus according to claim 1 including a dampening member between the first and second plates.

11. An exercise apparatus, comprising:

an exercise module comprising:

a first plate hinged to a second plate;

a spring between the first and second plates and normally biasing the first plate away from the second plate into an open position;

a bracket member comprising:

a triangular bracket having a base member, an upright member and an angular member interconnecting the base member and the upright member;

wherein the first plate of the exercise module is mounted to the angular member; and a strap capable of mounting bracket to a support surface.

12. The exercise apparatus according to claim 11 wherein the angular member includes means for adjustably mounting the exercise module thereto.

13. The exercise apparatus according to claim 11 wherein the angular member defines an angle $\alpha$ between the angular member and the base member, and including means for varying the angle $\alpha$.

14. The exercise apparatus according to claim 11 wherein the base member includes at least one pair of slots therein and a strap extends through the slots for mounting the bracket member to a support surface.

15. The exercise apparatus according to claim 11 wherein the first plate is movable relative to the first plate between the first position and a second position, and wherein each movement of the first plate from the first position to the second position defines a repetition, and further including a counter having a display for providing the user with a visual indication of the number of repetitions.

16. The exercise apparatus according to claim 11 including a timer activated when the first plate moves from the first position to the second position.

17. An exercise apparatus, comprising:

an exercise module comprising a first plate pivotally interconnected to a second plate at respective first ends thereof with a pin;

a torsion spring connected to the pin and bearing against the first and second plates to normally bias the first plate away from the second plate into an open position;

a bracket member comprising a triangular bracket having a base member, an upright member and an angular member interconnecting the base member and the upright member, the angular member having a longitudinal slot therein;

a strap for mounting the bracket member to a surface;

wherein the exercise module is mounted to the angular member with at least one fastener extending through an opening in the second plate and through the longitudinal slot in the angular member.

18. The exercise apparatus according to claim 17 wherein the first plate is movable relative to the first plate between the open position and a close position, and wherein each movement of the first plate from the open position to the closed position defines a repetition, and including means for counting the number of repetitions.

19. The exercise apparatus according to claim 18 wherein the angular member defines an angle $\alpha$ between the angular member and the base member and including means for varying the angle $\alpha$.

20. The exercise apparatus according to claim 18 including a dampener between the first and second plates.

* * * * *